US010154546B2

(12) United States Patent
Diehl

(10) Patent No.: US 10,154,546 B2
(45) Date of Patent: Dec. 11, 2018

(54) INDUCTOR FOR INDUCTION HEATING

(71) Applicant: Siemens Aktiengesellschaft, Munich (DE)

(72) Inventor: Dirk Diehl, Bubenreuth (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 318 days.

(21) Appl. No.: 15/024,081

(22) PCT Filed: Sep. 12, 2014

(86) PCT No.: PCT/EP2014/069513
§ 371 (c)(1),
(2) Date: Mar. 23, 2016

(87) PCT Pub. No.: WO2015/043984
PCT Pub. Date: Apr. 2, 2015

(65) Prior Publication Data

US 2016/0219652 A1 Jul. 28, 2016

(30) Foreign Application Priority Data

Sep. 26, 2013 (DE) ..... 10 2013 219 368

(51) Int. Cl.
*H05B 6/10* (2006.01)
*E21B 43/24* (2006.01)

(52) U.S. Cl.
CPC ..... *H05B 6/10* (2013.01); *E21B 43/2401* (2013.01); *E21B 43/2408* (2013.01); *H05B 6/108* (2013.01); *H05B 2214/03* (2013.01)

(58) Field of Classification Search
CPC ..... H05B 6/10; H05B 6/108; E21B 43/2401; E21B 43/2408
USPC ..... 219/549, 607, 634, 636, 650, 656
See application file for complete search history.

(56) References Cited

U.S. PATENT DOCUMENTS

| | | | | |
|---|---|---|---|---|
| 8,371,371 | B2 | 2/2013 | Diehl et al. | 166/60 |
| 8,766,146 | B2 | 7/2014 | Diehl | 219/600 |
| 2008/0047733 | A1* | 2/2008 | Axakov | H05B 3/56 174/110 R |
| 2011/0042063 | A1* | 2/2011 | Diehl | E21B 43/2401 166/60 |
| 2012/0181858 | A1* | 7/2012 | Hellinger | B60L 5/005 307/9.1 |

(Continued)

FOREIGN PATENT DOCUMENTS

| | | | | |
|---|---|---|---|---|
| DE | 102007040605 | B3 | 10/2008 | E21B 43/24 |
| DE | 102008062326 | A1 | 9/2009 | E21B 43/24 |

(Continued)

OTHER PUBLICATIONS

German Office Action, Application No. 102013219368.8, 8 pages, dated May 30, 2014.

(Continued)

*Primary Examiner* — Thien S Tran
(74) *Attorney, Agent, or Firm* — Slayden Grubert Beard PLLC

(57) ABSTRACT

An inductor is provided for induction heating of deposits of oil sand, oil shale, or extra-heavy oil using current-carrying conductors, in which a partial discharge at interruptions in the conductors is avoided.

12 Claims, 1 Drawing Sheet

(56) References Cited

U.S. PATENT DOCUMENTS

| | | | | |
|---|---|---|---|---|
| 2014/0301017 | A1 | 10/2014 | Diehl et al. | 361/301.4 |

FOREIGN PATENT DOCUMENTS

| | | | | |
|---|---|---|---|---|
| DE | 102009019287 | A1 | 11/2010 | E21B 43/24 |
| DE | 102009042127 | A1 | 3/2011 | B60L 9/00 |
| WO | 2009/027305 | A2 | 3/2009 | E21B 43/24 |
| WO | 2009/109489 | A1 | 9/2009 | E21B 43/24 |
| WO | 2013/060610 | A1 | 5/2013 | E21B 36/04 |
| WO | 2015/043984 | A1 | 4/2015 | E21B 36/04 |

OTHER PUBLICATIONS

International Search Report and Written Opinion, Application No. PCT/EP2014/069513, 17 pages, dated Dec. 4, 2014.

* cited by examiner

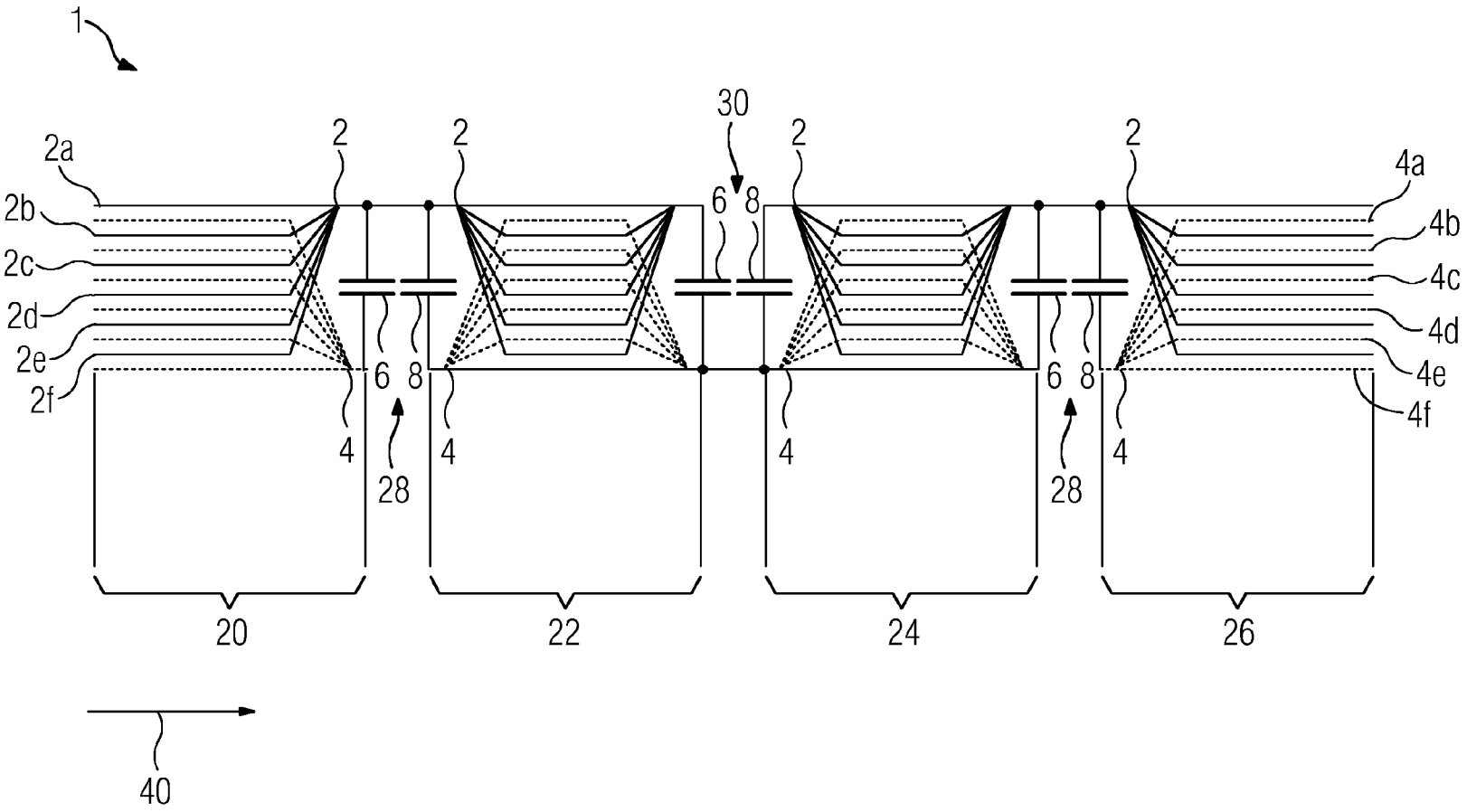
1
2a
2b
2c
2d
2e
2f
2
4
6
8
28
30
20
22
24
26
40
4a
4b
4c
4d
4e
4f

INDUCTOR FOR INDUCTION HEATING

CROSS-REFERENCE TO RELATED APPLICATIONS

This application is a U.S. National Stage Application of International Application No. PCT/EP2014/069513 filed Sep. 12, 2014, which designates the United States of America, and claims priority to DE Application No. 10 2013 219 368.8 filed Sep. 26, 2013, the contents of which are hereby incorporated by reference in their entirety.

TECHNICAL FIELD

The invention relates to an inductor for the induction heating of deposits of oil sand, oil shale or extra-heavy oil.

BACKGROUND

When extra-heavy oils or bitumen are extracted from oil sand or oil shale reservoirs using piping systems, it is necessary to achieve the greatest possible flowability of the oils to be extracted. The piping systems are introduced here through bore holes provided for this purpose. For instance, an increase in the flow speed can be achieved by increasing the temperature of the reservoirs (underground reservoirs). According to the prior art, induction heaters, known as inductors, are used herefor. Inductive heating is used exclusively or in an assistive manner to increase the temperature particularly with a steam-assisted gravity drainage method (SAGD method).

In order to achieve a heating output which is adequate for the required increase in temperature, large current intensities of a few hundred amperes are typically required, since the reservoir surrounding the inductor is in most cases only slightly electrically conductive. Moreover, an alternating current intensity is applied to the inductor, the frequency of which typically lies in the range of 10 kHz to 200 kHz. As a result, a high inductive voltage drop along an elongated inductor is however produced, the length of which can in most instances amount to more than 1 km. In most cases the inductive voltage drop therefore lies in the order of magnitude of a few 100 kV. Such a voltage can, in practice, only be handled easily, thereby rendering it necessary to compensate for this.

Such a compensation can take place for instance by capacitors connected in series, as described in the patent specification DE: 10 2007 040 605.5. The current-carrying conductors of the inductor are interrupted here and as a result have interruption locations.

The disadvantage of such a series connection of capacitors is that the interruptions embody weak points of the inductor. Partial discharges may occur at the interruption locations which may result in damage to the inductor.

SUMMARY

One embodiment provides an inductor for the inductive heating of deposits of oil sand, oil shale or extra-heavy oil using current-carrying conductors comprising at least two areas which each have at least one first and one second multifilament conductor, and a connection of the first type of the two areas, wherein the connection of the first type is embodied such that the first multifilament conductor of the first area is coupled to the second multifilament conductor of the first area by way of a first capacitor, the first multifilament conductor of the first and second area are connected in an electrically conducting manner, and the second multifilament conductor of the second area is electrically coupled to the first multifilament conductor of the first area by way of a second capacitor.

In a further embodiment, the inductor includes a further third area, which is electrically connected to the second area by way of a connection of the second type, wherein the connection of the second type is embodied such that the first multifilament conductor of the second area is electrically coupled to the second multifilament conductor of the second area by way of a further first capacitor, the second multifilament conductor of the second and third area are connected in an electrically conducting manner, and the first multifilament conductor of the third area is electrically coupled to the second multifilament conductor of the second area by way of a further second capacitor.

In a further embodiment, the inductor includes more than three areas, wherein each two areas are alternately connected in each case to a connection of the first and second type.

In a further embodiment, the first and second multifilament conductor each comprises at least two conductors, wherein the conductors embody the filaments of the multifilament conductor.

In a further embodiment, the first and second multifilament conductor comprises a plurality of at least 1000 and at most 5000 conductors, wherein the conductors embody the filaments of the multifilament conductor.

In a further embodiment, the individual conductors of the multifilament conductors essentially run in parallel along a longitudinal axis of the inductor.

In a further embodiment, the individual conductors of the multifilament conductors embody an interlaced structure, which extends along a longitudinal axis of the inductor.

In a further embodiment, the at least two multifilament conductors are capacitively coupled at least in the first and in the second area, so that a third capacitor is embodied in the respective area.

In a further embodiment, a total capacitance of the first and second capacitors is lower than a total capacitance of the third capacitors.

In a further embodiment, the first and/or second capacitor each comprises two electrodes, wherein the electrodes are embodied by a merging of individual conductors of a multifilament conductor.

In a further embodiment, the electrodes are hemispherical.

In a further embodiment, a space, which is arranged between the two electrodes of the first capacitor and/or of the second capacitor comprises a ceramic or mineralized insulating material.

In a further embodiment, the insulating material comprises at least one material from the mica group.

BRIEF DESCRIPTION OF THE DRAWING

Example aspects of the invention are described below with reference to FIG. 1, which shows a schematic representation of an inventive inductor according to one example embodiment.

DETAILED DESCRIPTION

Embodiments of the present invention provide an improved inductor.

Some embodiments provide an inventive inductor for the induction heating of deposits of oil sand, oil shale or extra-heavy oil using current-carrying conductors, which comprises at least two areas and a connection of the first type of the two areas, wherein the two areas each comprise at least one first and one second multifilament conductor. The connection of the first type is embodied such that the first multifilament conductor of the first area is electrically coupled via a first capacitor to the second multifilament conductor of the first area, the first multifilament conductor of the first and second area are connected in an electrically conducting manner and the second multifilament conductor of the second area is electrically coupled to the first multifilament conductor of the first area by way of a second capacitor.

A partial discharge at interruption locations of the inductor is avoided. The interruption location of the inductor corresponds here to the interruption of the second multifilament conductor by the first capacitor.

The avoidance of partial discharges is achieved by the multifilament conductors being connected by way of a first and second capacitor in the manner provided by claim 1. In particular, conductors of the respective multifilament conductors are linked in accordance with the invention by way of a shared first and/or second capacitor. It should be noted here that the conductors of a multifilament conductor are either understood to be all conductors of the multifilament conductor or at least one part of the conductors of the multifilament conductor.

It is advantageous that the first and second capacitors are connected in parallel to the capacitances of the conductors (line capacitances) of an area so that there is a parallel connection. The total capacitance of the respective area increases here since the capacitances of capacitors connected in parallel add up.

The inventive inductor may thus advantageously combine distributed capacitors with concentrated capacitors. Distributed capacitors are understood here to mean the line capacitances. Concentrated capacitors are understood to be the first and second capacitors.

A combination of concentrated and distributed capacitors is thus proposed in accordance with the invention, which allows for a capacitative compensation of the inductor without partial discharges.

In other words, some embodiments of the invention can be described as follows:

The second multifilament conductor of the first area of the inductor is interrupted at least once. The conductors of the second multifilament conductor of the first area are electrically coupled at the interruption by way of a concentrated first capacitor with the conductors of the uninterrupted first multifilament conductor. Provision is made by way of a concentrated second capacitor to electrically capacitively connect the second multifilament conductor of the second area with the uninterrupted first multifilament conductor of the first area. The first multifilament conductor of the first area is connected to the first multifilament conductor of the second area and is thus not interrupted with a connection of the first type. In particular, the conductors of the first and second multifilament conductor upstream and downstream of the connection are merged by way of the first and/or second capacitor to form one conductor in each case.

According to one embodiment, the inductor comprises a further third area, which is electrically connected to the second area by way of a connection of the second type, wherein the connection of the second type is embodied such that the first multifilament conductor of the second area is electrically coupled to the second multifilament conductor of the second area by way of a further first capacitor, the second multifilament conductor of the second and third area are connected in an electrically conducting manner and the first multifilament conductor of the third area is electrically coupled to the second multifilament conductor of the second area by way of a further second capacitor. A connection of the second type advantageously corresponds to a connection of the first type, in which the first and second multifilament conductors are interchanged. A symmetry is created as a result between the first and second multifilament conductor. The inductor voltage drop of the first and second multifilament conductor is compensated as a result.

According to a further embodiment, the inductor comprises more than three areas, wherein two areas are alternately connected to a connection of the first and second type in each case.

An inductor with a number of areas is advantageously enabled here. It is particularly advantageous that partial discharges at interruptions in the multifilament conductors are avoided by the connection of the first and second type and it is thus possible to prevent damage to the inductor by partial discharges even with a plurality of areas.

In one embodiment, the first and second multifilament conductor comprises in each case at least two conductors, wherein the conductors embody the filaments of the multifilament conductor.

A conductor of the first multifilament conductor is always advantageously capacitively coupled here to a conductor of the second multifilament conductor. Line capacitances and thus distributed capacitances are embodied as a result.

In a further embodiment, the first and second multifilament conductor comprises a plurality of at least 1000 and at most 5000 conductors, wherein the conductors embody the filaments of the multifilament conductor.

As a result, the heating output of the inductor is advantageously significantly increased.

According to one embodiment, the individual conductors of the multifilament conductors essentially run in parallel along a longitudinal axis of the inductor.

The line capacitance is advantageously increased as a result.

According to a further embodiment, the individual conductors of the multifilament conductors form an interlaced structure, which extends along a longitudinal axis of the inductor.

As a result, a cable arrangement of the multifilament conductors is advantageously enabled, which is stabilized on the one hand by the interlacing and is suited on the other hand to forming concentrated capacitances (line capacitances).

In one embodiment, the at least two multifilament conductors are capacitively coupled at least in the first and in the second area, so that a third capacitor is embodied in the respective area.

The third capacitor advantageously corresponds here to the line capacitances of the areas.

In a further embodiment, a total capacitance of the first and second capacitors is lower than a total capacitance of the third capacitors.

A total capacitance of the first and second capacitor is particularly advantageous, which contributes less than 5% to the total capacitance of the third capacitors.

According to one embodiment, the first and/or second capacitor each comprises two electrodes, wherein the electrodes are embodied by merging individual conductors of a multifilament conductor.

This advantageously assists with avoiding partial discharges at the interruption locations. The first and/or second capacitor is therefore embodied by merging the conductors of the multifilament conductors coupled by the first and/or second capacitor.

According to a further embodiment, the electrodes are embodied hemi spherically.

This advantageously assists with avoiding partial discharges at the interruption locations.

In one embodiment, a space, which is arranged between the two electrodes of the first capacitor and/or of the second capacitor, comprises a ceramic or mineralized insulating material.

This particularly advantageously assists with avoiding partial discharges at the interruption locations.

In a further embodiment, the insulating material comprises at least one material from the mica group.

Materials from the mica group have a high impact strength, thereby also advantageously assisting with the avoidance of partial discharges at the interruption locations.

FIG. 1, the sole FIGURE, shows a schematic representation of an inductor 1, which has at least four areas 20, 22, 24, 26 along a longitudinal axis 40, according to an example embodiment. Adjacent areas 20, 22, 24, 26 are in each case alternately connected to a connection of the first type 28 and a connection of the second type 30 in respect of the longitudinal axis 40. Each of the areas 20, 22, 24, 26 has two multifilament conductors 2, 4, wherein the multifilament conductors 2, 4 each have six conductors 2*a* . . . *f*, 4*a* . . . *f*. In each area, the conductors 2*a* . . . *f* of the first multifilament conductor 2 are capacitatively coupled to the conductors 4*a* . . . *f* of the second multifilament conductor 4. Such a capacitive coupling is enabled by the parallel arrangement of the conductors 2*a* . . . *f*, 4*a* . . . *f*, along the longitudinal axis 40 of the inductor 1.

The connection of the first type 28 has a first and second capacitor 6, 8. The multifilament conductor is merged to form a conductor prior to connection by way of the first and/or the second capacitor 6, 8. Here the first capacitor 6 couples the first and second multifilament conductors 2, 4 of the first area 20. The second capacitor 8 couples the first multifilament conductor 2 of the first area 20 with the merged second multifilament conductor 4 of the second area 22. The first multifilament conductor 2 of the first area 20 is merged and electrically coupled to the merged first multifilament conductor 2 of the second area 22.

A third area 24 connects to the second area 22. The second area 22 is now connected here to the third area 24 by way of a connection of the second type 30. The merged and interrupted first multifilament conductor 2 of the second area 22 is coupled to the merged second multifilament conductor 4 of the second area 22 by way of a first capacitor 6. The merged second multifilament conductor 4 of the second area 22 is finally electrically connected to the merged second multifilament conductor 4 of the third area 24. In addition, the, in turn, merged multifilament conductor 2 of the third area 24 is capacitively coupled to the second multifilament conductor 4 of the second area 22 by way of a second capacitor 8.

The cited and recognizable plane now proceeds along the longitudinal axis 40 of the inductor 1. As a result a fourth area 26 follows the third area 24, said fourth area being connected to the third area 24 with a connection of the first type 28. This plan can generally be applied to any number of areas 20, 22, 24, 26 of the inductor 1.

The capacitively coupled conductors 2*a* . . . *f*, 4*a* . . . *f* form distributed capacitors in the areas 20, 22, 24, 26. By contrast, capacitors 6, 8 concentrated by the first and second capacitors 6, 8, are embodied in the connections of the first and second type 28, 30. As a result, distributed capacitors are advantageously combined with concentrated capacitors 6, 8 along the inductor 1, so that partial discharges at interruption locations are avoided and an inductor which is improved compared with the prior art is thus provided.

What is claimed is:

1. An inductor for inductive heating of deposits of oil sand, oil shale or extra-heavy oil using current-carrying conductors, the inductor comprising:

at least two areas, each having at least one first multifilament conductor and a second multifilament conductor, a first type of connection of the two areas embodied such that:

the first multifilament conductor of the first area is coupled to the second multifilament conductor of the first area via a first capacitor, the first multifilament conductor of the first and second area are connected in an electrically conducting manner, and the second multifilament conductor of the second area is electrically coupled to the first multifilament conductor of the first area via a second capacitor, wherein at least one of the first capacitor and the second capacitor comprises two electrodes defined by a merging of individual conductors of a multifilament conductor.

2. The inductor of claim 1, further comprising a third area that is electrically connected to the second area via a second type of connection embodied such that:

the first multifilament conductor of the second area is electrically coupled to the second multifilament conductor of the second area via a further first capacitor, the second multifilament conductor of the second and third area are connected in an electrically conducting manner, and the first multifilament conductor of the third area is electrically coupled to the second multifilament conductor of the second area via a further second capacitor.

3. The inductor of claim 2, comprising more than three areas, wherein the areas are alternately connected via a first type of connection and a second type of connection.

4. The inductor of claim 1, wherein each of the first and second multifilament conductor comprises at least two conductors, wherein the conductors embody the filaments of the multifilament conductor.

5. The inductor of claim 1, wherein the first and second multifilament conductors comprise a plurality of at least 1000 and at most 5000 conductors, wherein the conductors embody the filaments of the multifilament conductor.

6. The inductor of claim 4, wherein the individual conductors of the multifilament conductors run substantially in parallel along a longitudinal axis of the inductor.

7. The inductor of claim 4, wherein the individual conductors of the multifilament conductors embody an interlaced structure that extends along a longitudinal axis of the inductor.

8. The inductor of claim 1, wherein the at least two multifilament conductors are capacitively coupled at least in the first area and the second area, such that a third capacitor is defined in the resulting coupling.

9. The inductor of claim 8, wherein a total capacitance of the first and second capacitors is lower than a total capacitance of the third capacitors.

10. The inductor of claim 1, wherein the electrodes are hemispherical.

11. The inductor of claim 10, wherein a space between the two electrodes of at least one of the first capacitor and the second capacitor comprises a ceramic or mineralized insulating material.

12. The inductor of claim 11, wherein the insulating material comprises at least one mica group mineral.

* * * * *